US011846411B2

(12) United States Patent
Lee

(10) Patent No.: US 11,846,411 B2
(45) Date of Patent: Dec. 19, 2023

(54) LIGHTING APPARATUS WITH HEAT RADIATION FUNCTION BY A BLOWING STRUCTURE EMPLOYING ANION GENERATION

(71) Applicant: VALKIDA CO., LTD., Anyang-si (KR)

(72) Inventor: Jae Sung Lee, Anyang-si (KR)

(73) Assignee: VALKIDA CO., LTD., Anyang-si (KR)

( * ) Notice: Subject to any disclaimer, the term of this patent is extended or adjusted under 35 U.S.C. 154(b) by 0 days.

(21) Appl. No.: 18/020,065

(22) PCT Filed: Feb. 25, 2021

(86) PCT No.: PCT/KR2021/002399
§ 371 (c)(1),
(2) Date: Feb. 6, 2023

(87) PCT Pub. No.: WO2022/039341
PCT Pub. Date: Feb. 24, 2022

(65) Prior Publication Data

US 2023/0296237 A1 Sep. 21, 2023

(30) Foreign Application Priority Data

Aug. 18, 2020 (KR) ..... 10-2020-0103280

(51) Int. Cl.
*F21V 29/63* (2015.01)
*F21K 9/66* (2016.01)
(Continued)

(52) U.S. Cl.
CPC ..... *F21V 29/63* (2015.01); *F21K 9/66* (2016.08); *F21V 29/83* (2015.01); *F21Y 2115/10* (2016.08)

(58) Field of Classification Search
CPC ..... F21V 29/63; F21V 29/83
See application file for complete search history.

(56) References Cited

U.S. PATENT DOCUMENTS 5,850,886 A 12/1998 Kouno et al.
2006/0078460 A1* 4/2006 Ryu ..... F21V 33/0064 422/5
2008/0305015 A1* 12/2008 Ryu ..... H01T 23/00 422/120

FOREIGN PATENT DOCUMENTS

JP 2005-228503 A 8/2005
JP 3186890 U 10/2013
(Continued)

OTHER PUBLICATIONS

Machine translation of JP 2014022148 A retrieved from the FIT database of PE2E search. (Year: 2023).*
(Continued)

*Primary Examiner* — Colin J Cattanach
(74) *Attorney, Agent, or Firm* — Maschoff Brennan

(57) ABSTRACT

A lighting apparatus having a heat radiation function by a blowing structure comprising a housing, a cylindrical anion emission pipe, a discharge electrode, an induction electrode, an LED circuit board, and a lighting cover. When anions are emitted from the discharge electrode, air outside the lighting cover is introduced into the cylindrical anion emission pipe via an air through-hole, and then discharged to the outside via a second end of the cylindrical anion emission pipe to be circulated; a space in which the LED circuit board is disposed is in air communication with the air through-hole, such that heat generated by an LED chip on the LED circuit board is emitted. The lighting apparatus may achieve excellent heat radiation function without employing a complicated or heavy heat radiation device.

4 Claims, 7 Drawing Sheets

(51) Int. Cl.
*F21Y 115/10* (2016.01)
*F21V 29/83* (2015.01)

(56) References Cited

FOREIGN PATENT DOCUMENTS

| | | | | | |
|---|---|---|---|---|---|
| JP | 2014-022148 | A | | 2/2014 | |
| JP | 2014022148 | A | * | 2/2014 | |
| KR | 97-0006047 | A | | 2/1997 | |
| KR | 20-0265693 | Y1 | | 2/2002 | |
| KR | 20-0310587 | Y1 | | 4/2003 | |
| KR | 10-0819376 | B1 | | 4/2008 | |
| KR | 100819376 | B1 | * | 4/2008 | |
| KR | 10-0926772 | B1 | | 11/2009 | |
| KR | 10-2011-0030898 | A | | 3/2011 | |
| KR | 20120025700 | A | * | 3/2012 | |
| KR | 10-1136048 | B1 | | 4/2012 | |
| KR | 10-1141660 | B1 | | 7/2012 | |
| KR | 10-2015-0114319 | A | | 10/2015 | |
| WO | WO-2006001597 | A1 | * | 1/2006 | ..... A61L 9/22 |

OTHER PUBLICATIONS

Machine translation of KR 100819376 B1 retrieved from the FIT database of PE2E search. (Year: 2023).*
Machine translation of KR 20120025700 A retrieved from the FIT database of PE2E search. (Year: 2023).*
KR Office Action dated Oct. 6, 2020 as received in Application No. 10-2020-0103280.
KR Decision to Grant dated Dec. 17, 2020 as received in Application No. 10-2020-0103280.

* cited by examiner

[FIG. 1]
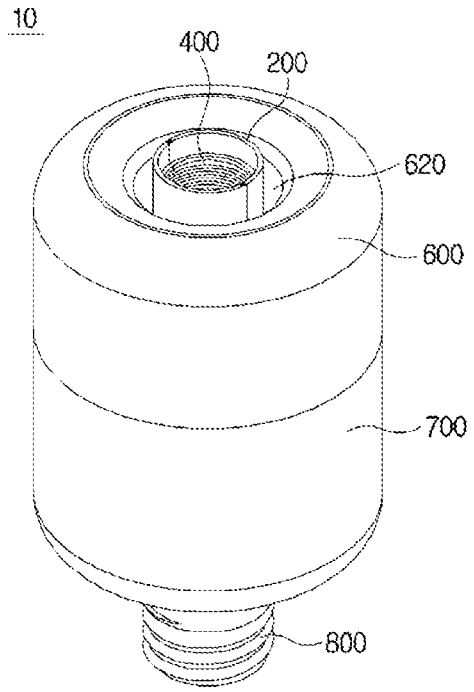

[FIG. 2]
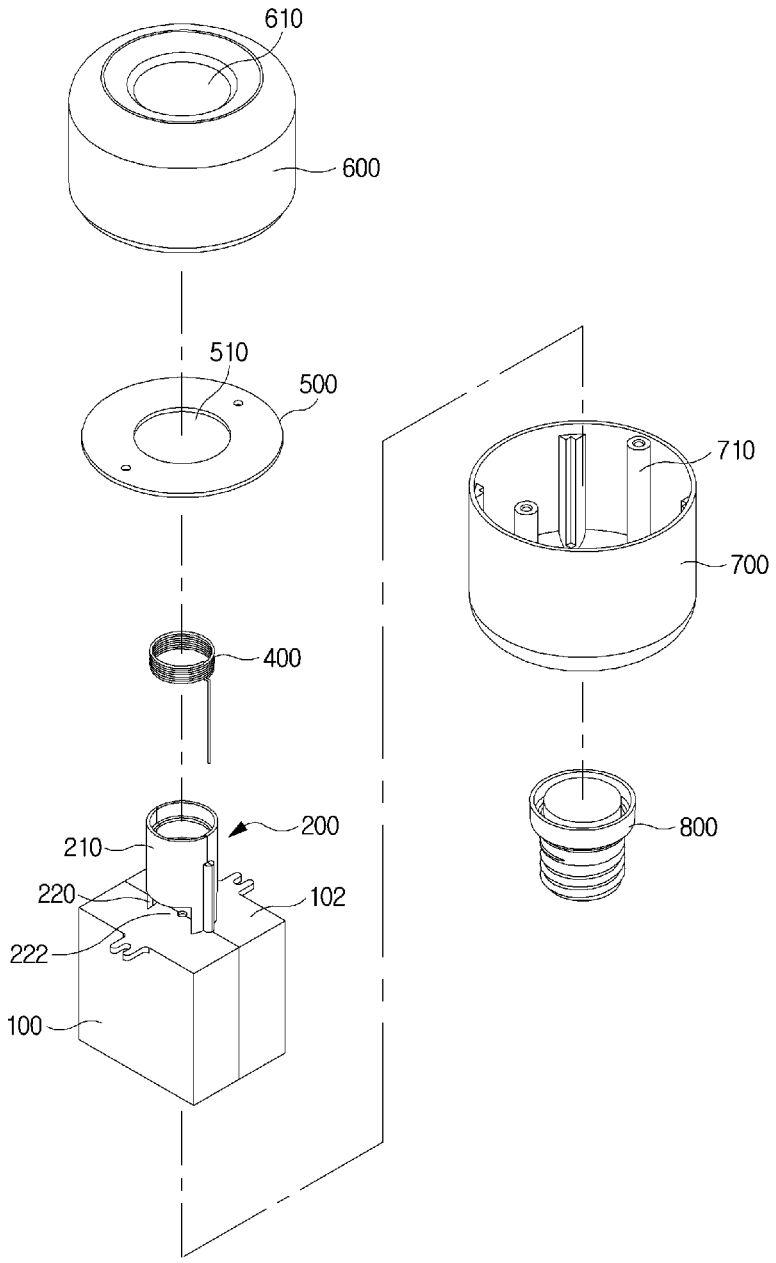

[FIG. 3]
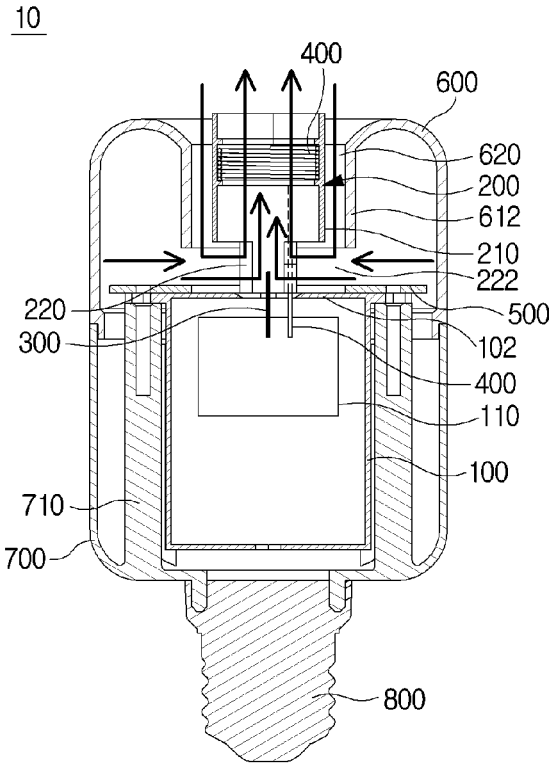

[FIG. 4]
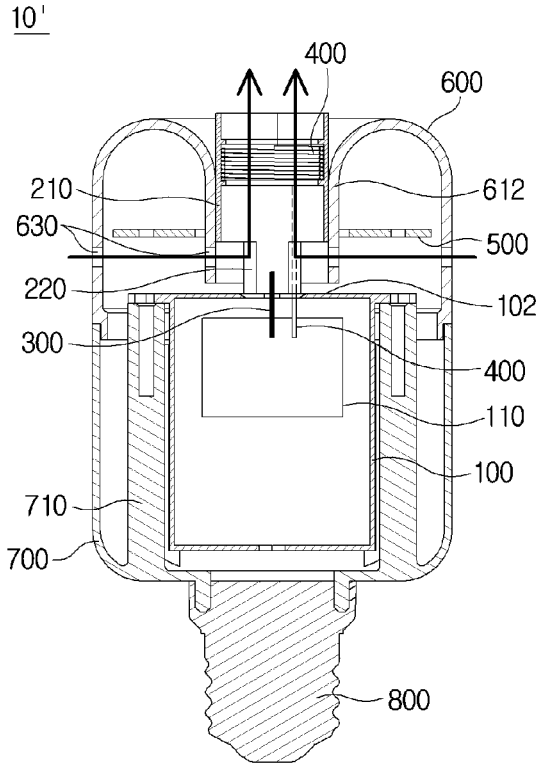

[FIG. 5]
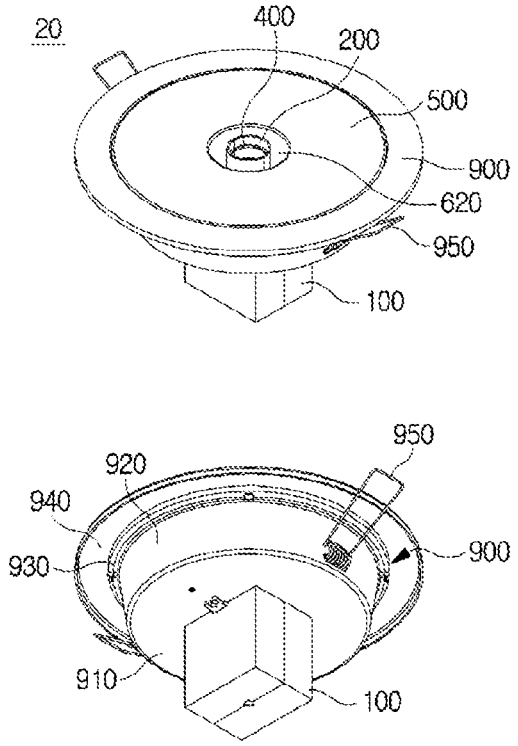

[FIG. 6]
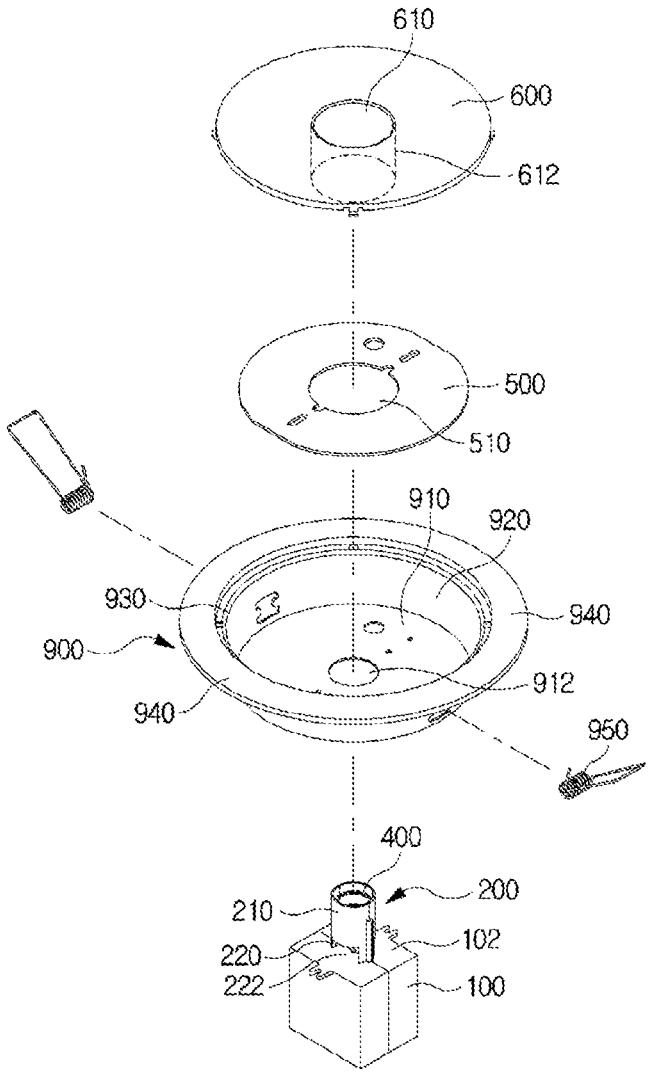

[FIG. 7]
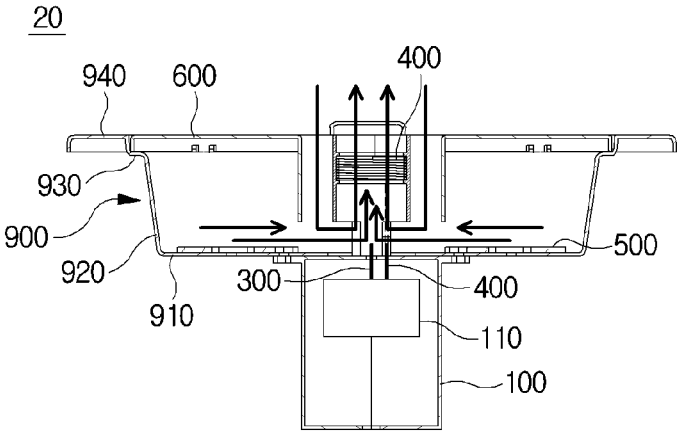

LIGHTING APPARATUS WITH HEAT RADIATION FUNCTION BY A BLOWING STRUCTURE EMPLOYING ANION GENERATION

FIELD OF INVENTION

The present invention relates to a lighting apparatus having a heat dissipation function due to a ventilation structure, and more particularly to a lighting apparatus with a ventilation structure which is capable of performing an excellent heat dissipation function without adopting a complicated or heavy heat dissipation structure.

BACKGROUND OF INVENTION

In general, lighting apparatuses are used to illuminate living spaces such as living rooms and bathrooms. In the past, incandescent lamps were used as a lighting apparatus, and then fluorescent lamps have been mainly used. Recently, replacement into LED lamps is being made.

LED lamps have advantages such as high energy efficiency and long service lifespan, but have a weakness in that they are vulnerable to heat. Accordingly, it is necessary to prevent the shortening of LED life and the reduction in lighting efficiency thereof by effectively dissipating heat generated by LED chips to the outside.

Korean Patent No. 10-0926772 (registered on Nov. 6, 2009) discloses a ceiling-embedded LED lighting, Korean Patent No. 10-1141660 (registered on Apr. 24, 2012) discloses the structure of a recessed LED downlight housing, and Korean Patent No. 10-1136048 (registered on Apr. 5, 2012) discloses an LED ceiling downlight with effective heat dissipation. The disclosed inventions are meaningful in terms of effectively dissipating heat from LEDs, but have limitations in that the heat dissipation structures employed are complex or heavy.

Meanwhile, Korean Patent Application Publication No. 1997-0006047 (published on Apr. 23, 1997) discloses a lighting device having an air cleaning function, Korean Utility Model Registration No. 20-0265693 (registered on Feb. 8, 2002) discloses a lighting device with an anion generator, Korean Utility Model Registration No. 20-0310587 (registered on Apr. 2, 2003) discloses a lighting lamp with a cartridge-type negative ion generator, and Korean Patent Application No. 10-2015-0114319 (published on Oct. 12, 2015) discloses a negative ions-generating LED light.

SUMMARY OF INVENTION

Technical Problem to be Solved

In the case of lighting devices provided with an anion generator according to existing technologies, the anion generator only implements an air-cleaning function by generating anions, but is irrelevant to a heat dissipation function of discharging and removing heat generated by LED chips to the outside.

Accordingly, the present inventors recognized that an excellent heat dissipation function can be achieved without adopting a complicated or heavy heat dissipation structure when an anion-generating means employed in the existing technologies regardless of an LED heat dissipation function is appropriately employed in an LED lighting apparatus, thus completing the present invention.

Therefore, the present invention has been made in view of the above problems, and it is one object of the present invention to provide a lighting apparatus having a heat dissipation function due to a ventilation structure, the lighting apparatus having excellent heat dissipation function without adopting a complicated or heavy heat dissipation structure.

Technical Solution

In accordance with an aspect of the present invention, the above and other objects can be accomplished by the provision of a lighting apparatus having a heat dissipation function due to a ventilation structure, the lighting apparatus including: a housing including an anion-generating module for generating anions; a cylindrical anion-emitting tube formed to protrude from a first surface of the housing; a discharge electrode formed to protrude the first surface of the housing corresponding to a center of the cylindrical anion-emitting tube; an induction electrode disposed on an inner surface of the cylindrical anion-emitting tube; an LED circuit board disposed on or above the housing corresponding to an outside of the cylindrical anion-emitting tube and provided with at least one LED chip; and a lighting cover configured to cover the LED circuit board, but not to cover the cylindrical anion-emitting tube.

In the lighting apparatus of the present invention, a first end of the cylindrical anion-emitting tube is closed by a first surface of the housing, but a second end of the cylindrical anion-emitting tube opposite to the first end is open, and anions emitted from the discharge electrode are emitted outward through the second end of the cylindrical anion-emitting tube; and an air through hole is formed on a lower side surface of the cylindrical anion-emitting tube, and the air through hole communicates with an outside through the lighting cover or by the lighting cover, so that when anions are emitted from the discharge electrode, air outside the lighting cover enters an inside of the cylindrical anion-emitting tube through the air through hole, and then is discharged and circulated outward through the second end of the cylindrical anion-emitting tube; and a space in which the LED circuit board is disposed is in air communication with the air through hole so that, when air flow is formed through the air through hole by anions emitted from the discharge electrode, air flow occurs also in a space in which the LED circuit board is disposed and heat generated from the LED chip of the LED circuit board is dissipated by the air flow.

In accordance with an embodiment of the present invention, a through hole having a diameter larger than an outer diameter of the cylindrical anion-emitting tube is formed on a central portion of the lighting cover so that an air passage is formed between a through hole wall forming the through hole of the lighting cover and the cylindrical anion-emitting tube and, accordingly, air outside the lighting cover enters an inside of the cylindrical anion-emitting tube through the air passage and the air through hole.

In accordance with another embodiment of the present invention, a through hole having a diameter the same as an outer diameter of the cylindrical anion-emitting tube may be formed at a central portion of the lighting cover, whereas air inlet holes are formed on a lower side surface of the lighting cover, so that air outside the lighting cover enters an inside of the cylindrical anion-emitting tube through the air inlet hole of the lighting cover and the air through hole of the cylindrical anion-emitting tube.

The induction electrode may be a coil-type electrode wound multiple times, and the discharge electrode may be a brush-type electrode composed of a plurality of fine wire strands.

In accordance with an embodiment of the present invention, the lighting apparatus may further include a housing-accommodating case for accommodating the housing, wherein the housing-accommodating case is coupled with the lighting cover so that a socket is formed in the housing-accommodating case.

In accordance with another embodiment of the present invention, the lighting apparatus further includes an LED circuit board-seating case for seating the LED circuit board, wherein the LED circuit board-seating case includes a through hole through which the cylindrical anion-emitting tube passes; a receiving part in which the LED circuit board is seated; and a seating step on which the lighting cover is seated.

Effect of Invention

A lighting apparatus having a heat dissipation function due to a ventilation structure according to the present invention can exhibit an excellent heat dissipation function without adopting a complicated or heavy heat dissipation structure.

BRIEF DESCRIPTION OF DRAWINGS

FIG. 1 illustrates a perspective view of a lighting apparatus according to a first embodiment of the present invention.

FIG. 2 illustrates an exploded perspective view of the lighting apparatus illustrated in FIG. 1.

FIG. 3 illustrates a cross-sectional view of the lighting apparatus illustrated in FIG. 1.

FIG. 4 illustrates a cross-sectional view of a lighting apparatus that is a modified embodiment modified from the lighting apparatus of FIG. 3.

FIG. 5 illustrates a perspective view of a lighting apparatus according to a second embodiment of the present invention.

FIG. 6 illustrates an exploded perspective view of the lighting apparatus illustrated in FIG. 5.

FIG. 7 illustrates a cross-sectional view of the lighting apparatus illustrated in FIG. 5.

DETAILED DESCRIPTION OF PREFERRED EMBODIMENTS OF INVENTION

Hereinafter, the present invention is described in detail with reference to the accompanying drawings.

FIGS. 1 to 3 illustrate a lighting apparatus according to a first embodiment of the present invention.

A lighting apparatus 10 according to a first embodiment of the present invention which generates anions and has a ventilation structure includes a housing 100, a cylindrical anion-emitting tube 200, a discharge electrode 300, an induction electrode 400, an LED circuit board 500, a light cover 600, a housing-accommodating case 700 and a socket 800.

The housing 100 of the present invention includes an anion-generating module 110 configured to generate anions. The anion-generating module 110 is generally employed in an anion generator and includes a voltage conversion circuit for generating a high voltage. In addition, the housing 100 may include a battery (not shown) for storing DC power and a power conversion device (not shown) for converting AC power into DC power to supply it to the battery. The DC voltage of the battery may be supplied into the anion-generating module and may be converted into a high voltage by the voltage conversion circuit. Although an embodiment in which the housing 100 is formed in the shape of a rectangular parallelepiped is shown in the drawings, the housing 100 may be formed in various other shapes.

The cylindrical anion-emitting tube 200 stands to be protruded from a first surface 102 of the housing 100. That is, the direction of the cylindrical anion-emitting tube 200 is perpendicular to the first surface 102 of the housing 100. Accordingly, a first end of the cylindrical anion-emitting tube 200 is blocked by the first surface 102 of the housing 100, whereas a second end of the cylindrical anion-emitting tube 200 opposite to the first end is open. The cylindrical anion-emitting tube 200 may be largely divided into a body part 210 and a connection part 220. The body part 210 is a part made of a complete cylindrical shape, and the connection part 220 extends from the body part 210, is connected to the housing 100 of the cylindrical anion-emitting tube 200, and does not a perfect cylindrical shape. In the drawing, an embodiment of the connection part 220 formed of two pillars is shown. An air through hole 222 is formed between the connection part 220 made of the two pillars. Accordingly, the cylindrical anion-emitting tube 200 has a structure in which the air through-hole 222 is formed on lower side thereof. Here, although an embodiment in which two air through holes 222 are formed is illustrated in the drawings, only one air through hole or a plurality of air through holes may be formed as needed. The size of the air through hole 222 is not particularly limited so long as it can substantially form an air flow as described below.

The discharge electrode 300 is installed to pass through the first surface 102 of the housing 100. The discharge electrode 300 is connected to the anion-generating module accommodated in the housing 100 to form a high voltage between the induction electrode 400 and the discharge electrode 300. Specifically, the discharge electrode 300 serves to emit electrons according to substantially the same principle as an electron gun. The discharge electrode 300 protrudes from the first surface 102 of the housing 100 corresponding to the center of the cylindrical anion-emitting tube 200. The discharge electrode 300 may be formed in a single needle shape with a pointed end or may be formed in a brush type composed of a plurality of fine wire strands. The shape and form of the discharge electrode 300 may be constructed referring to an existing art commonly applied to an anion generator.

The induction electrode 400 is disposed on an inner surface of the cylindrical anion-emitting tube 200. Like the discharge electrode 300, the induction electrode 400 is connected to the anion-generating module accommodated in the housing 100 and serves to form a high voltage between the discharge electrode 300 and the induction electrode 400. Electrons emitted from the discharge electrode 300 by a high voltage fly in the direction in which the induction electrode 400 induced, but because the speed is fast and the force is strong, the electrons are not collected by the induction electrode 400, pass between the induction electrode 400, and are emitted to the outside of the cylindrical anion-emitting tube 200. The induction electrode 400 may be formed in a cylindrical shape attached to the inner surface of the cylindrical anion-emitting tube 200, but is preferably formed in a coiled electrode shape wound multiple times. A height at which the induction electrode 400 is installed on the cylindrical anion-emitting tube 200 is preferably set higher than the height of an end of the discharge electrode 300. A vertical distance between the discharge electrode 300 and the induction electrode 400 and the number of windings of the induction electrode 400 may be appropriately adjusted in consideration of an anion emission amount and an anion emission rate. The shape and arrangement of the discharge electrode 300 may be determined referring to an existing art.

The LED circuit board 500 is disposed on or above the housing 100 corresponding to the outside of the cylindrical anion-emitting tube 200. At least one LED chip (not shown) is formed on the LED circuit board 500. Here, the LED chip provides illumination by receiving DC power and emitting light. As shown in the drawings, the LED circuit board 500 may be formed in a donut shape. Power supplied to the LED circuit board 500 may be supplied from a battery included in the housing 100, or may be AC power supplied from the outside through the socket 800. When power supplied to the LED circuit board 500 is AC power supplied from the outside, the LED circuit board 500 may be provided with an IC chip including a power conversion circuit for converting AC power into DC power.

A lighting cover 600 covers the LED circuit board 500, but does not cover the cylindrical anion-emitting tube 200. Specifically, as shown in FIGS. 1 to 3, through hole 610 having a diameter larger than the outer diameter of the cylindrical anion-emitting tube 200 is provided at the center of the lighting cover 600. Accordingly, as shown in FIG. 3, an air passage 620 is formed between a through hole wall 612 forming the through hole 610 of the lighting cover 600 and the cylindrical anion-emitting tube 200. Due to such a construction, air outside the lighting cover 600 enters the inside of the cylindrical anion-emitting tube 200 through the air passage 620 and the air through hole 222. The air that has entered the inside of the cylindrical anion-emitting tube 200 may be discharged to the outside through a second end of the cylindrical anion-emitting tube 200 so that it may be circulated. Meanwhile, the LED circuit board 500 with a donut shape is accommodated in an inner space formed by an upper surface and outer surface of the through hole wall 612 of the lighting cover 600.

In the lighting apparatus 10 of the present invention, a space in which the LED circuit board 500 is disposed is in air communication with the air through hole 222 and also in air communication with the air passage 620. For this, the part of the lighting cover 600 forming the air passage 620 is not in close contact with the first surface of the housing 100 and is positioned above the housing 100 at a certain distance, as shown in FIG. 3. That is, the space where the LED circuit board 500 is disposed is in air communication with the air through hole 222 and the air passage 620 by a gap formed between the part of the lighting cover 600 forming the air passage 620 and the first surface of the housing 100. Air communication between the space where the LED circuit board 500 is disposed and the air through hole 222 and the air passage 620 is indicated by arrows indicating airflow in FIG. 3.

Meanwhile, the lighting apparatus 10 includes the housing-accommodating case 700 for accommodating the housing 100. The housing-accommodating case 700 may be provided with a plurality of fixing supports 710 to fixedly support the accommodated housing 100. The housing-accommodating case 700 is coupled with the lighting cover 600. The socket 800 is formed on an opposite side of the light cover 600 on the housing-accommodating case 700. The socket 800 is inserted into a socket room provided in a ceiling light and serves as a connection port for receiving AC power from the outside.

According to the above configuration, the lighting apparatus 10 according to the present invention may continuously emit anions to a sufficiently far distance to the outside by an anion-emitting module 110 included in the housing 100, the cylindrical anion-emitting tube 200, the discharge electrode 300 and the induction electrode 400 while providing illumination by the LED chip provided on the LED circuit board 500.

Specifically, anions, especially electrons, are emitted from the discharge electrode 300 by a high voltage formed between the discharge electrode 300 and the induction electrode 400 by the anion-emitting module. The emitted electrons are induced by the induction electrode 400 and emitted to the outside of the cylindrical anion-emitting tube 200. Here, since the discharge electrode 300 is installed on the first surface 102 of the housing 100 and the cylindrical anion-emitting tube 200 is also installed on the first surface 102 of the housing 100, airflow inside the cylindrical anion-emitting tube 200 is very limitedly formed if the air through hole 222 is not formed on the side surface of the cylindrical anion-emitting tube 200 and, accordingly, it is difficult to emit anions, emitted from the discharge electrode 300, far away from the cylindrical anion-emitting tube 200.

On the other hand, in the present invention, since the air through hole 222 is formed on a side surface of the cylindrical anion-emitting tube 200 and the air through hole 222 is connected to the air passage 620 formed by the through hole wall 612 of the lighting cover 600 and the cylindrical anion-emitting tube 200, an air circulation path wherein air outside the lighting cover 600 enters the inside of the cylindrical anion-emitting tube 200 through the air passage 620 and the air through hole 222 and the entered air is discharged to the outside through the second end of the cylindrical anion-emitting tube 200 is formed. In the present invention, since anions generated from the discharge electrode 300 are discharged from the cylindrical anion-emitting tube 200 by air flow circulating along the air circulation path, the anions may be emitted far enough outside.

In addition, according to the above configuration, since the space, in which the LED circuit board 500 is disposed, in the lighting apparatus 10 according to the present invention is in air communication with the air through hole 222 and in air communication also with the air passage 620, air flow occurs also in the space, in which the LED circuit board 500 is disposed, when air flow is formed through the air through hole 222 by anions emitted from the discharge electrode 300. In addition, heat generated from the LED chips on the LED circuit board 500 is dissipated due to the air flow. To facilitate airflow in the space in which the LED circuit board 500 is disposed, a fine or appropriately sized air distribution hole may be formed in a necessary part of the lighting cover 600, i.e., another part of the lighting cover 600 other than the part of the lighting cover 600 forming the air passage 620, as needed.

FIG. 4 illustrates a lighting apparatus 10' according to a modified embodiment manufactured by slightly modifying the lighting apparatus of the first embodiment. Differences between the embodiment shown in FIG. 4 and the embodiment of FIGS. 1 to 3 are as follows.

A diameter of the through hole 610 of the lighting cover 600 is the same as an outer diameter of the cylindrical anion-emitting tube 200. That is, the air passage 620 is not formed between the through hole wall 612 of the lighting cover 600 and the cylindrical anion-emitting tube 200. Instead, at least one air inlet hole 630 is formed on a lower side surface of the lighting cover 600. Accordingly, air outside the lighting cover 600 enters the inside of the cylindrical anion-emitting tube 200 through the air inlet hole 630 of the lighting cover 600 and the air through hole 222 of the cylindrical anion-emitting tube 200.

Meanwhile, the LED circuit board 500 is preferably disposed at a position higher than the position where the air inlet hole 630 of the lighting cover 600 is formed. When the LED circuit board 500 is disposed at a lower position than the position where the air inlet hole 630 of the lighting cover 600 is formed, air introduced into the air inlet hole 630 of the lighting cover 600 is distributed throughout the inner space of the lighting cover 600 from the top of the LED circuit board 500, which is inefficient in forming airflow and have a weak but bad effect such as dimming LED light of the LED circuit board 500. On the other hand, when the LED circuit board 500 is disposed at a higher position than the position where the air inlet hole 630 of the lighting cover 600 is formed, the LED circuit board 500 itself forms an air passage, which is efficient in forming an air flow. In addition, it is preferable because there is no effect such as blurring of the LED light due to air circulation.

In the lighting apparatus 10' shown in FIG. 4, a space where the LED circuit board 500 is disposed is in air communication with the air inlet hole 630 of the lighting cover 600 and the air through hole 222 of the cylindrical anion-emitting tube 200. Accordingly, as described above, air flow occurs also in the space, where the LED circuit board 500 is disposed, when air flow is formed through the air through hole 222 by anions emitted from the discharge electrode 300, and heat generated from the LED chips of the LED circuit board 500 is dissipated by the generated air flow.

FIGS. 5 to 7 illustrate a lighting apparatus according to a second embodiment of the present invention.

A lighting apparatus 20 according to the second embodiment includes an LED circuit board-seating case 900 in which the LED circuit board 500 is seated. A bottom surface of the LED circuit board-seating case 900 is formed in a circular plate shape, and a through hole 912 through which the cylindrical anion-emitting tube 200 passes is formed at the center of the LED circuit board-seating case 900. A bottom surface 910 extends while being connected to a cylindrical sidewall 920, and a seating step 930 extending in a radial direction is formed at an end of the sidewall 920. A disk-shaped extension 940 is formed to extend vertically from the end of the seating step 930, and then to expand again in a radial direction.

The cylindrical anion-emitting tube 200 is fitted into the through hole 912 of the LED circuit board-seating case 900, and the LED circuit board 500 is seated on the bottom surface 910. Next, the lighting cover 600 is placed on the seating step 930. The through hole wall 612 is formed at the center of the lighting cover 600 to form a through hole 610 having a larger diameter than the outer diameter of the cylindrical anion-emitting tube 200. Accordingly, the through hole wall 612 may be vertically coupled to the disk-shaped lighting cover 600 having a through hole at the center thereof. Here, the through hole wall 612 of the lighting cover 600 is inserted into a through hole 510 of the donut-shaped LED circuit board 500.

Due to such a structure, the air passage 620 is formed between the through hole wall 612 forming the through hole 610 of the lighting cover 600 and the cylindrical anion-emitting tube. Accordingly, air outside the lighting cover 600 enters the inside of the cylindrical anion-emitting tube through the air passage 620 and the air through hole 222 of the cylindrical anion-emitting tube 200.

In addition, in the lighting apparatus 20 of the present invention, the part of the lighting cover 600 forming the air passage 620 is not in close contact with the bottom surface 910 of the LED circuit board-seating case 900 and is positioned above the bottom surface 910 of the LED circuit board-seating case 900 at a certain distance, as shown in FIG. 7. That is, the space where the LED circuit board 500 is disposed is in air communication with the air through hole 222 and the air passage 620 by a gap formed between the part of the lighting cover 600 forming the air passage 620 and the bottom surface 910 of the LED circuit board-seating case 900. Air communication between the space where the LED circuit board 500 is disposed and the air through hole 222 and the air passage 620 is indicated by arrows indicating airflow in FIG. 7.

According to the above configuration of the lighting apparatus 20 according to the present invention, since the space in which the LED circuit board 500 is disposed is in air communication with the air through hole 222 and in air communication also with the air passage 620, air flow occurs also in the space, in which the LED circuit board 500 is disposed, when air flow is formed through the air through hole 222 by anions emitted from the discharge electrode 300. In addition, heat generated from the LED chips on the LED circuit board 500 is dissipated due to the air flow. To facilitate airflow in the space in which the LED circuit board 500 is disposed, a fine or appropriately sized air distribution hole may be formed in a necessary part of the lighting cover 600, i.e., another part of the lighting cover 600 other than the part of the lighting cover 600 forming the air passage 620, as needed.

The lighting apparatus 20 according to the second embodiment is a type embedded in a ceiling light, and an outer side of the sidewall 920 of the LED circuit board-seating case 900 is provided with two or more latching members 950 that are supported by the force of a spring. The latching members 950 serves to hang the lighting apparatus 20 on a ceiling so that the lighting apparatus 20 does not fall downward after being inserted into a buried opening formed in the ceiling.

Other constructions and actions of the lighting device 20 according to the second embodiment are the same as those described in the first embodiment, so a detailed description thereof is omitted.

The invention claimed is:

1. A lighting apparatus having a heat dissipation function due to a ventilation structure, the lighting apparatus comprising:

a housing comprising an anion-generating module for generating anions;

a cylindrical anion-emitting tube formed to protrude from a first surface of the housing;

a discharge electrode formed to protrude the first surface of the housing corresponding to a center of the cylindrical anion-emitting tube;

an induction electrode disposed on an inner surface of the cylindrical anion-emitting tube;

an LED circuit board disposed on or above the housing corresponding to an outside of the cylindrical anion-emitting tube and provided with at least one LED chip; and a lighting cover configured to cover the LED circuit board, but not to cover the cylindrical anion-emitting tube, wherein a first end of the cylindrical anion-emitting tube is closed by a first surface of the housing, but a second end of the cylindrical anion-emitting tube opposite to the first end is open, and anions emitted from the discharge electrode are emitted outward through the second end of the cylindrical anion-emitting tube, an air through hole is formed on a lower side surface of the cylindrical anion-emitting tube, and the air through hole communicates with an outside through the lighting cover or by the lighting cover, so that when anions are emitted from the discharge electrode, air outside the lighting cover enters an inside of the cylindrical anion-emitting tube through the air through hole, and then is discharged and circulated outward through the second end of the cylindrical anion-emitting tube, a space in which the LED circuit board is disposed is in air communication with the air through hole so that, when air flow is formed through the air through hole by anions emitted from the discharge electrode, air flow occurs also in a space in which the LED circuit board is disposed and heat generated from the LED chip of the LED circuit board is dissipated by the air flow, a through hole having a diameter larger than an outer diameter of the cylindrical anion-emitting tube is formed on a central portion of the lighting cover so that an air passage is formed between a through hole wall forming the through hole of the lighting cover and the cylindrical anion-emitting tube and, accordingly, air outside the lighting cover enters an inside of the cylindrical anion-emitting tube through the air passage and the air through hole.

2. The lighting apparatus according to claim 1, wherein the induction electrode is a coil electrode wound multiple times, and the discharge electrode is a brush electrode composed of a plurality of fine wire strands.

3. The lighting apparatus according to claim 1, further comprising a housing-accommodating case for accommodating the housing, wherein the housing-accommodating case is coupled with the lighting cover so that a socket is formed in the housing-accommodating case.

4. The lighting apparatus according to claim 1, further comprising an LED circuit board-seating case for seating the LED circuit board, wherein the LED circuit board-seating case comprises a through hole through which the cylindrical anion-emitting tube passes; a receiving part in which the LED circuit board is seated; and a seating step on which the lighting cover is seated.

* * * * *